LOCKING MEANS FOR AUTOMOBILE DOORS

The present invention relates to locking means for automobile doors and more particularly to push-button type locking means.

Push-button type locking means is widely adopted in rear door assemblies of automobiles. Conventional locking means of this type has been found inconvenient in that locking and unlocking operations are performed only through the use of a key. It has therefore been required, in order to lock the door while the engine is being operated, to stop the engine for removing the key from the engine key switch assembly and use the key for locking the door.

It is therefore an object of the present invention to provide push-button type locking means for automobile doors which can be brought into locking position without using a key.

Another object of the present invention is to provide push-button type locking means having a manually operated locking means which can be manually actuated into locking position only when the automobile door is in open position.

According to the present invention, in order to accomplish the above and other objects, there is provided push-button type locking means for automobile doors which comprises pivotable latching means movable between a latching position wherein it is in latching engagement with striker means and an unlatching position wherein it is disengaged from said striker means, means for biasing said latching means into the unlatching position, claw means movable between an operative position wherein it is engaged with the latching means so as to hold the latching means in the latching position and an inoperative position wherein it releases the latching means so as to allow the latching means to move under the biasing force of the biasing means into the unlatching position, a lock body carrying push-button means for axial movement with respect thereto, said push-button means including rotatable means having a portion adapted to engage when the push-button means is axially depressed to cause the axial movement thereof with said claw means to force the latter into the inoperative position, swingable lever means having a manually actuatable portion, said rotatable means having abutting means adapted to engage with cooperative abutting means on said lever means to prevent the axial movement of the push-button means, said lever means being movable between a locking position wherein the abutting means on the lever means engages with the abutting means on the rotatable means to prevent the axial movement of the pushbutton means and an unlocking position wherein said abutting means on said lever means is retracted to allow the axial movement of the push-button, said rotatable element being provided with means engageable with said lever means to rotate, when the push-button means is rotated by the key in unlocking direction, the lever means into the unlocking position.

According to the present invention, the swingable lever means can be manually actuated into the locking position when the door is in open position so that the door can be locked upon closing the door. Preferably, the lever means is so located that the manually actuable portion is positioned between the door and a stationary part of automobile body when the door is closed. In this arrangement, the lever means is manually actuatable only when the door is opened. The present invention is particularly suitable for application to a rear door assembly of an automobile but may also be applied to locking means for other automobile doors.

The above and other objects and features of the present invention will become apparent from the following descriptions of preferred embodiments taking reference to the accompanying drawings, in which;

FIG. 1 is a fragmentary side view showing the rear portion of an automobile having a rear hatch door;

FIG. 2 is a fragmentary sectional view showing the locking mechanism adopted in the rear door;

FIG. 3 is a sectional view of the locking mechansim particularly showing the push-button device in the mechanism;

FIG. 4 is a perspective view showing a rotatable element associated with the push-button;

FIG. 5 is a perspective view of a swingable lever element adapted to cooperate with the rotatable element shown in FIG. 4;

FIG. 6 (I) shows the lever element in operative position;

FIG. 6 (III) shows the lever element in inoperative position; and,

FIG. 7 shows an alternative embodiment of the swingable lever means.

Referring now to the drawings, particularly to FIGS. 1 and 2, the automobile shown therein has a body provided with a rear hatch door assembly 1 which is hinged to the body at the upper edge thereof. As shown in FIG. 2, the door assembly 1 is comprised of an outer panel 2 and an inner panel 8. The door assembly 1 is provided with a locking mechanism for locking the door assembly 1 in the closed position.

The locking mechanism includes a latching element 5 pivotably mounted on the inner panel 8 of the door assembly 1 through a suitable bracket (not shown). The latching element 5 has a bifurcated latching finger 7 projecting outwardly through an aperture 9 in a lower land portion 8*a* of the inner panel 8 for engagement with a striker 11 provided on a floor 10 of the automobile at a portion confronting to the lower land portion 8*a*. The latching element 5 is movable between a latching position in which the latching finger 7 is in latching engagement with the striker 11 and an unlatching position in which it is disengaged from the striker 11. A spring 6 is provided for biasing the latching element 5 into the unlatching position.

On the door assembly 1, there is also mounted a claw lever 4 which is pivotable between an operative position in which it engages with ratchet teeth 12 on the latching element 5 to hold the latter in the latching position and an inoperative or releasing position in which it is disengaged from the latching element 5 so as to allow the latter to move under the force of the spring 6 into the unlatching position. Although not shown in the drawings, the claw lever 4 is spring biased so that it is normally maintained in the operative position.

In order to move the claw lever 4 into the inoperative position so that the latching element 5 is released and allowed to move into the unlatching position, there is provided a push-button assembly which includes, as shown in FIG. 3, a handle element 14 secured to the outer panel 2 of the door assembly 1 and a cylindrical lock body 15 secured to the handle 14. In the lock body 15, there is disposed a push-button 3 which has a radially projecting key 3*a* formed on an annular flange 3*b*. The key 3*a* is in slidable engagement with a longitudi-

COMBINATION LOCK EXTRACTION APPARATUS

FIELD OF THE INVENTION

This invention relates in general to lock extraction apparatus and more particularly to improved and more economical lock extraction apparatus for use with combination locks of the axially movable tumbler pin type such as, for example, employed in the control of switchbear.

SUMMARY OF THE PRIOR ART

Combination locks of the axially movable type are widely used for access or control purposes. Such locks or lock cylinders employ tumbler pins which are moved axially by an operating key carrying a combination of pins projecting a distance correspondence to the axial travel of the tumbler pins required to enable rotation. When the tumbler pins are moved axially to a proper position, the operating key may be rotated in a selected direction to rotate the lock tumbler barrel and move the lock bolt.

In order to extract such combination lock from the front of its housing, one procedure utilizes an extraction key carrying a combination of projecting pins corresponding to the respective operating key. The extraction key is engaged with the lock cylinder and the operator may rotate the tumbler barrel in either direction and when the desired alignment is secured between a movable lock part and a portion of the lock housing, removal of the lock cylinder is permitted. The extraction key however is not universal or mastered to a large member of lock cylinders, nor is the position to which the extraction key operates the tumbler barrel fixed so that some manipulation may be required. A further problem arises in some applications as the tumbler barrel can be optionally rotated in either direction by an extraction key. This type of arrangement may be hazardous in some situations.

As an example, to enable or disable selected apparatus such as switchgear, each piece of apparatus is provided with one or more locks or lock cylinders each controlled by a respective operating key to in turn permit movement of a common bolt for controlling the associated apparatus. For safety reasons the operating keys are provided authorized personnel only and initial rotation of the respective tumbler barrel is permitted in only a selected direction. It may under these circumstances be hazardous to use an extraction key, which can rotate the tumbler barrel in either direction.

Under many circumstances it is desired to ensure that one piece of apparatus be in a desired condition before the condition of another piece of apparatus be altered. To ensure the proper condition of each piece of apparatus one or more operating keys are releasable from their respective lock only if other locks at that apparatus are properly conditioned.

The released operating key or keys can then be removed for operating a respective lock at the other apparatus. This ensures that each piece of apparatus is properly conditioned before the condition of another piece of apparatus can be changed. However if the sequence in which control is exercised over the apparatus or if other apparatus is to be controlled by an operating key common to several pieces of apparatus in the same or another sequence, changes in the lock cylinders may be required.

Since an extraction tool of the type described above may rotate the tumbler barrel in either direction its use presents safety problems for some applications. The practice therefore with combination locks of the axially movable pin type when used for purposes such as described is to press fit the lock cylinders in their housings and permit initial rotation by an operating key only in the selected direction. When a lock change is required, it is therefore necessary to replace the entire lock and housing assembly. This can be quite expensive since a large number of locks may be provided in a single housing.

SUMMARY OF THE INVENTION

The present invention utilizes a combination lock of the axially movable pin type having a tumbler barrel, which is rotatable by an extraction key only in a direction opposite that in which the lock is rotated by any operating key to eliminate any safety problems.

The invention further utilizes an extraction key universal to a large number of combination locks of the axially movable pin type. The one extraction key can therefore extract a selected large number of combination locks. The direction of rotation and angular distance of rotation are also automatically controlled so that each lock is easily and conveniently removed from the front of the housing. This arrangement provides a simple inexpensive and improved extraction procedure for general use with combination locks of the axially movable pin type.

Controlling the direction of rotation is accomplished by providing each lock cylinder with two pair of axially offset bayonet grooves or slots. One pair of slots extend arcuately in one direction and are engaged by bayonet pins on the operating key to enable initial rotation of the drive plate in the selected direction to control the bolt and the other pair of slots extend arcuately in the opposite direction. The other pair of slots are engaged by bayonet pins on the extraction key to enable initial rotation of the drive plate only in the opposite direction for disengaging the lock cylinder from the housing. The bayonet pins of the extraction and operating keys are offset from their operating pins by a distance corresponding to the offset in the bayonet slots so that each moves the lock tumbler pins the proper distance when the bayonet pins are aligned with the respective bayonet slots or grooves. Thus the direction of operation for the operating key may be selected as desired and the extraction key will automatically operate the corresponding lock in the opposite direction irrespective of which direction is selected for the operating key.

The present invention also provides that the extraction key may directly remove a lock cylinder from the front of the housing without requiring removal of the housing and permits lock cylinders to be easily changed for altering the control sequence of apparatus at different locations. In addition the present invention enables multiple locks to be easily provided with each under control of a different operating key for insuring a desired sequence of lock operations.

It is, therefore, among the primary objects of the present invention to provide an improved or more economical lock extraction apparatus or assembly.

It is another object of the present invention to provide an improved and/or more economical key interlock system or method for controlling the operation and the release of any one of a plurality of lock cylinders.

Other objects and the features of the present invention will become apparent on examination of the following specification and claims together with the drawings.

DESCRIPTION OF THE PREFERRED EMBODIMENT

Figure 1:
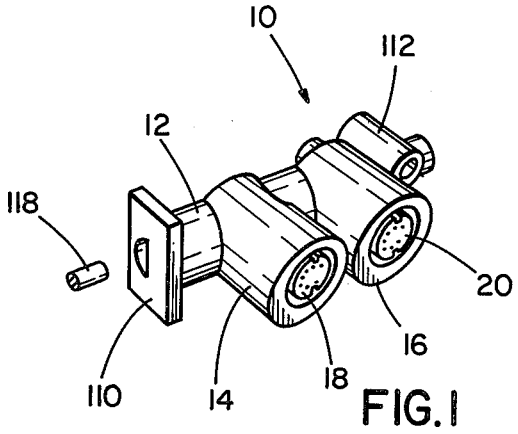
FIG. 1 is an isometric view of a lock assembly incorporating the principles of the present invention.
Figure 3:
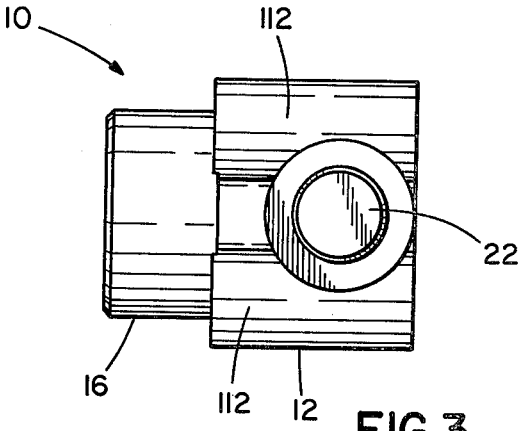
FIG. 3 is an end elevational view of the assembly shown in FIG. 1.
Figure 2:
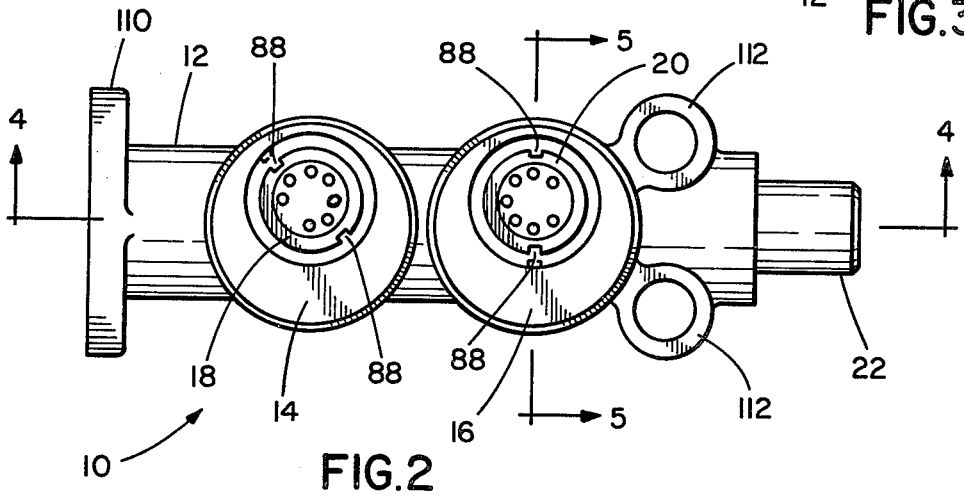
FIG. 2 is a front elevational view of the assembly shown in FIG. 1.

In FIGS. 1–3 a lock assembly incorporating the principles of the present invention is indicated by the reference character 10. The lock assembly 10 includes a housing 12 having spaced parallel hollow bosses 14 and 16 each defining a passage 17 in which a respective combination lock cylinder 18 and 20 of the axially movable tumbler type is secured for controlling a bolt 22.

Figure 7:
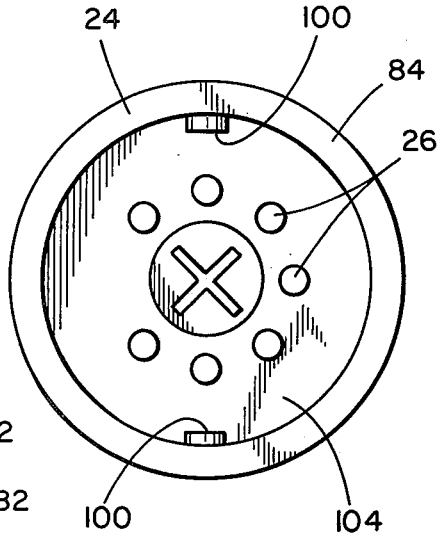
FIG. 7 is a front elevational view of an operating key.
Figure 8:
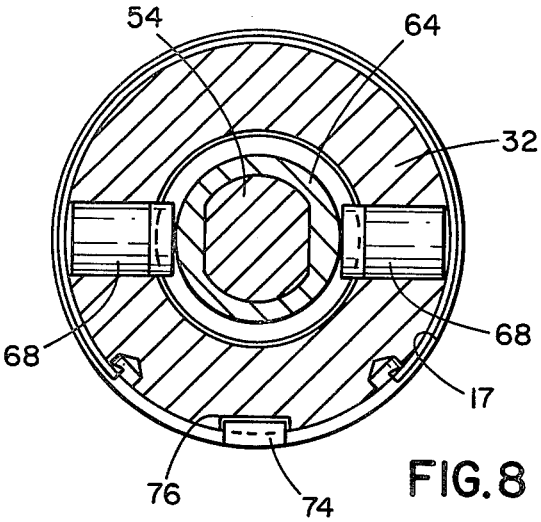
FIG. 8 is a sectional view taken through the line 8—8 in FIG. 5.
Figure 9:
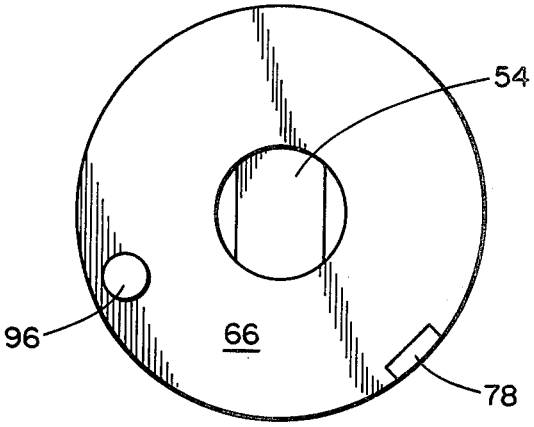
FIG. 9 is a rear elevational view of a lock cylinder.
Figure 10:
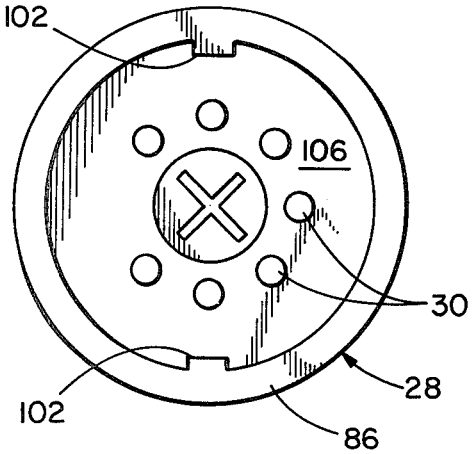
FIG. 10 is a front end elevational view of a master key.
Figure 11:
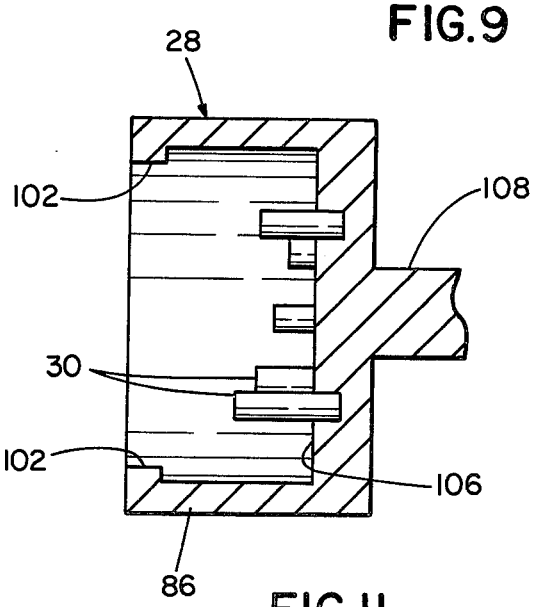
FIG. 11 is a sectional view of a portion of a master key.
Figure 13:
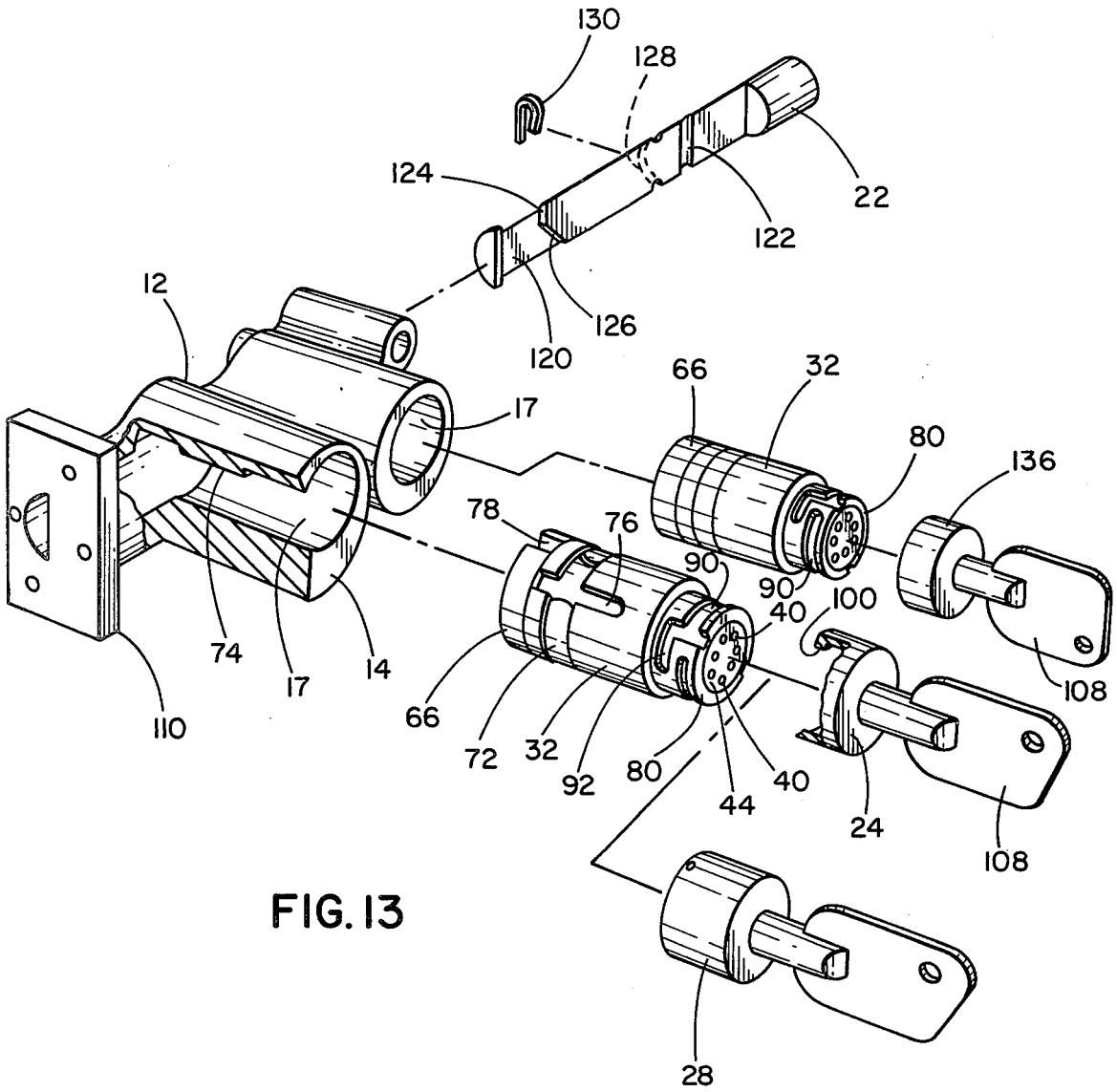
FIG. 13 is an exploded isometric view of the lock assembly shown in FIG. 1 with the housing partially broken away together with the respective operating keys and the master key.

Each lock cylinder or cylinder assembly 18 and 20 is operated by a respective operating key such as 24 having tumbler control means or operating pins 26 as seen in FIGS. 7 and 13, and are removed from the respective housing boss 14 and 16 by a common lock cylinder extraction key 28 having tumbler control means or operating pins 30 as seen in FIGS. 10, 11 and 13.

The combination lock cylinders 18 and 20 are of an axial tumbler type such as manufactured by Van Lock Co., 3609 Church St., Newton, Cincinnati, Ohio 54244 and shown in respective brochures such as those published by the Van Lock Company entitled "HOW TO CHANGE COMBINATIONS ON VAN LOCK & KEY," "BEVERAGE TRUCK DOOR LOCK SYSTEMS," or "VENDING MACHINE & BEVERAGE TRUCK DOOR LOCK SYSTEMS."

Figure 5:
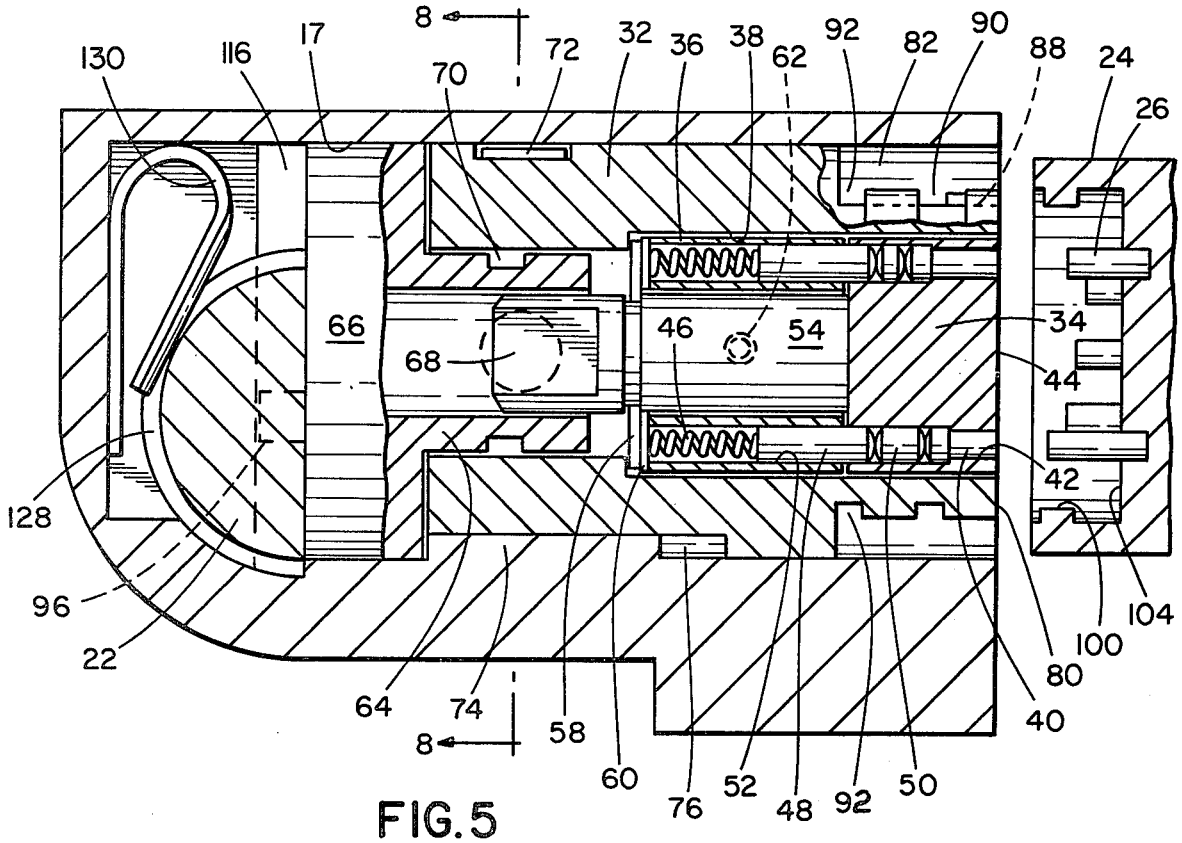
FIG. 5 is a sectional view taken generally along the line 5—5 in FIG. 2.
Figure 6:
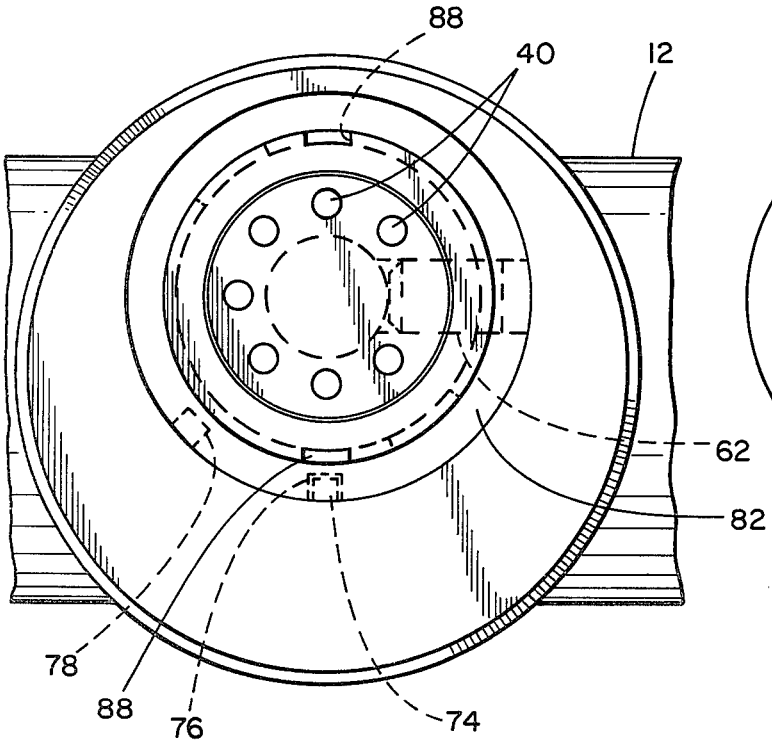
FIG. 6 is an enlarged fragmentary view of a portion of the lock assembly shown in FIG. 1.

The locks or lock cylinders 18 and 20 as best seen in FIG. 5 each include an outer sleeve or annular member 32 carrying a pair of coaxially adjacently spaced tumbler barrels 34 and 36 received in an axial passage 38 of a sleeve member 32. A plurality of spirally spaced tumbler pins 40 extend axially in respective passages 42 of the end barrel 36 from one end face 44 of the end barrel 34. End face 44 is substantially coincident with a corresponding end of sleeve 32 and the open end of the respective boss 14 or 16.

The pins 40 each have a stop shoulder thereon engaged with a stop shoulder in the respective passage 42 under the bias of respective springs 46 transmitted through respective aligned pin 48 and a respective intermediate or master pin 50 so that the ends of pins 40 are substantially flush with the end face 44 of the end tumbler barrel 34. The springs 46 and a portion of pins 48 are located in a respective passage 52 of the inner barrel 36 with the pins 48 extending across adjacent or mating end faces of barrels 34 and 36 into respective passages 42 to prevent relative rotation therebetween in the normal or locked condition.

The inner barrel 36 is annular and a rearwardly extending shaft 54 on barrel 34 extends through barrel 36. The shaft 54 has an annular surface recess substantially coincident with a radially inwardly extending shoulder of the sleeve passage 38 for receiving a retaining member 58. Member 58 seats against the shoulder in passage 38 and secures a closure member 60 to the adjacent end of barrel 36 for closing the corresponding end of each passage 52 and holding the springs 46. The barrel 36 is secured to sleeve 32 by means of a radially extending threaded member 62 and with the retaining member capturing shaft 54 between the barrel 36 and the shoulder in passage 38, the barrel 34 cannot be moved axially from sleeve 32 to permit changing the tumbler pins without first removing member 62.

The shaft 54 extends into a reduced diameter portion of passage 38 in sleeve 32 and has a non-circular end for receipt in a non-circular end of a sleeve shaft 64 projecting forwardly from a cylindrical drive plate 66 so that the drive plate 66 rotates with shaft 54, when tumbler barrel 34 is rotated by the respective operating key 24 or a master key 28.

The drive plate 66 seats against the end of the sleeve 32 and is retained against axial movement from the sleeve by pins such as 68 extending radially through sleeve 32 and having a projecting end engaged in a peripheral recess 70 of the shaft 64. A C ring 72 fitted in a peripheral recess of the sleeve shaft 64 retains the pins 68 in the sleeve 32, while permitting rotation of the shaft 64 and the drive plate 66. Plate 66 in turn seats against the inner end of a key 74 formed on the inner periphery of each boss 14 and 16 to retain the respective lock cylinder in the boss.

Sleeve 32 has a slot 76 in the outer periphery of the sleeve for receiving a key 74 of the respective boss 14 or 16 so that the sleeve 32 cannot rotate relative the boss. With pins 48 extending across the mating or engaged faces of barrels 34 and 36, the barrel 34 likewise cannot rotate relative barrel 36, sleeve 32 or the respective boss. The shaft 54 is therefore also held immobile, to in turn hold the shaft 64 and the drive plate 66 stationary.

It will be noted that the drive plate 66 is located behind the key 74 so that the periphery of the plate is in inteferring relationship with the key or boss 74 to prevent withdrawal of the lock cylinder assembly 18 or 20 from the respective boss. A slot 78 is provided in the periphery of each drive plate 66 for alignment with the boss 74, when the drive plate is rotated in the proper direction by a lock cylinder extraction key 28, as will be explained, to permit withdrawal of the lock cylinder 18 or 20 from the boss.

The sleeve 32 is provided with a reduced diameter annular portion 80 axially coincident with barrel 34 and terminating with face 44 at the end face of the respective boss 16 or 18. The reduced diameter portion 80 defines an annular space or passage 82 for receipt of a respective annular rim wall 84 or 86 on the end of either a cup shaped operating key 24 or a cup shaped lock removal master key 28 respectively.

The outer periphery of the reduced diameter portion 80 is also provided with a pair of diametrically opposed axially extending bayonet type arcuate grooves or slots 88 each communicating with one groove of a pair of bayonet type receiving grooves 90 and 92 formed in the periphery of portion 89. Grooves 92 are offset axially from grooves 90 toward a shoulder on sleeve 32 and extend in the opposite angular direction from grooves 90 and both pair of grooves 90 and 92 extend through a respective pre-determined angular distance. The arcuate or angular extent of the groove 90 is selected in accordance with the desired angle through which it is desired to rotate or move a pin 96 or 98 projecting from one end raidl face of the respective drive plate to control the travel of bolt 22 accordingly. The angle through which the slots 92 extend is determined by the distance through which plate 66 is to be rotated for aligning slot 78 with key 74. Preferably grooves 92 extend for 45° so that rotation of the drive plate through 45° counterclockwise for example aligns slot 78 with key 74 to enable withdrawal of the lock cylinder. Grooves 90 may then extend through an angle of 150° or more in the clockwise direction to permit a large angular movement of the drive plate without aligning slot 78 with key 74. Other angles and directions of rotation may of course be chosen.

Grooves 90 of each lock cylinder are adapted to receive a pair of diametrically opposed bayonent pins 100 at the end of the annular wall 84 of a respective operating key 24 and the grooves 92 of each lock cylinder are adapted to receive a pair of bayonet pins 102 at the end of annular wall 86 of the master key 28.

The cup shaped keys 24 and 28 each have a back wall 104 and 106 respectively from which circumferentially spaced axially projecting tumbler operating pins 26 and 30 project in one direction and an operating handle 108 projects in the other direction. The pins 26 extend axially to different lengths as compared to other pins 26 of the same key in accordance with the combination of the respective lock. The pins 30 of the extraction key extend axially in accordance with a standard and predetermined or master pattern universal or common to a plurality of operating keys and locks. The length of the annular wall 84 or 86 from the back wall 104 or 106 is chosen so that the bayonet pins 100 of each operating key 24 align only with grooves 90, when the back wall 104 of the key is fully engaged with the end face 44 and the sleeve end face. Wall 104 therefore acts as a stop wall while the orientation of the tumbler operating pins polarizes the bayonet pins 100 relative alignment with grooves 90.

Likewise, the length of annular wall 86 on key 28 is chosen so that bayonet pins 102 align with grooves 92 only when properly polarized and when the stop wall 106 is fully engaged with face 44. Therefore an operating key 24 cannot be used to rotate the drive plate for removing the lock cylinder and an extraction key 28 cannot be used to operate the drive plate for controlling the bolt.

Figure 4:
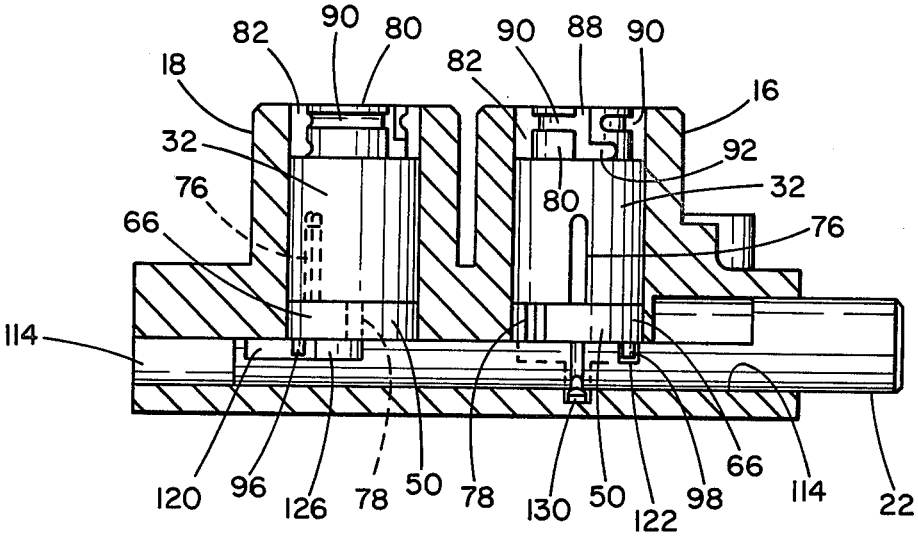
FIG. 4 is a sectional view taken generally along the line 4—4 in FIG. 2.
Figure 12:
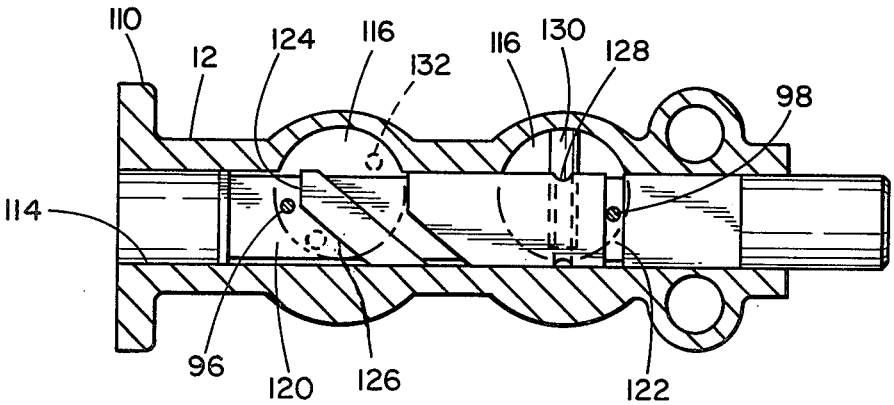
FIG. 12 is a sectional view taken longitudinally of the housing and bolt.

The housing 12 has an end flange 110 at one end and a pair of spaced hollow mounting bosses 112 adjacent the end of housing 12 opposite flange 110 for enabling the housing 12 to be mounted on a support. The housing 12 also includes a semi-cylindrical passage 114 as best seen in FIGS. 4 and 12 for receiving the bolt 22, which extends transverse to the hollow bosses 14 and 16 for communication with the blind end of each passage 17 in the bosses. The number of bosses 14 and 16 and lock cylinders are selected as desired or needed in accordance with the number of locks, which are required to be operated for controlling the bolt travel. Thus, it may be required that three, four or even more locks be operated before the bolt can be used to enable selected apparatus in which case each lock will be operated by a respective key, which is retained in the lock before bolt travel is permitted.

The bolt 22 is provided with a semi-cylindrical portion extending in passage 114 past the end of passage 17 to prevent relative rotation and both the bolt and passage 114 have a full cylindrical end portion adjacent the end opposite flange 110. The flat faces defined by the semi-cylindrical bolt and passage portions prevent rotation of the bolt and since the communicating end of passage 17 is larger than the bolt, a space 116 is provided above the bolt by each passage 17. The end of the bolt 22 adjacent flange 110 is adapted to engage a plunger 118, for example, of a switch carried by flange 110, or it may engage a bolt of another housing engaged with flange 110 in response to movement of the bolt to a corresponding end or limit position. The other cylindrical end of the bolt on movement from the other end of the housing may operate or permit the operation or disablement of selected apparatus or machinery.

The flat face of the semi-cylindrical portion of the bolt faces the passages 17 and is provided with a pair of spaced radially extending recesses 120 and 122 aligned with a respective passage 17 for receiving a respective actuator pin 96 and 98 projecting from the rear surface of a respective rotatable drive plate 66. The radial edges of recess 120 are spaced apart a greater distance than the radial edges of recess 122 and recess 120 has a stop edge 124 and an inclined lower radial edge surface 126 to accommodate the movement of the pin 96 for enabling release of the lock cylinder or assembly from the respective boss.

Recess 122 is just large enough to accommodate pin 98, and its radial edges are spaced for engaging pin 98 along a line generally tangent to the rotational arc of pin 98 to permit pin 98 to move the bolt from the housing or to retract the bolt into the housing only when pin 98 is disengaged from stop surface 124.

In addition a recess 128 is provided in the arcuate periphery bolt 22 for engagement with one leg of a spring 130. Spring 130 is located in a recess of the housing adjacent the end of boss 16 to restrain the bolt against disengagement from the housing in the event the housing passage is aligned vertically and both lock cylinders 18 and 20 are removed.

Normally the bolt 22 in the arrangement shown herein cannot be retracted into the housing 12 when the operating key for each lock cylinder is withdrawn. Pin 96 is then located to engage radial edge 124 of the bolt. Therefore, if an attempt should be made to operate lock cylinder 20 with a respective operating key rotation of pin 98 to move the lock is prevented.

Thus to operate the bolt 22, the wall 84 of an operating key 24 corresponding to cylinder 18 is engaged over reduced portion 80 of cylinder 18 with pins 100 aligned with grooves 88. The wall 84 is moved over barrel 34 until face 44 engages wall 106. At that time pins 100 are aligned with grooves 90 and if the pins 100 are properly inserted, the axially offset spirally spaced pins 26 move respective pins 40, 48 and 50 axially against the bias of spring 46 to align the interface of pins 48 and 50 with the interface of barrels 34 and 36. This permits relative rotation between the barrels 34 and 36. The key 24 is therefore rotated with pins 100 moving freely in slots 90 and the pins 30 rotate barrel 34 and shaft 54 clockwise, for example, as seen in the drawings, until the key pins engage the groove ends.

As shaft 54 rotates, it in turn rotates shaft 64 to rotate the drive plate 66 and pin 96 to a position indicated at 132 in space 116 above the bolt. At that time pins 100 are engaged with the stop ends or surfaces at the ends of respective grooves 90 and key 24 must be retained in position before another key such as 24 corresponding to cylinder 20 can be used to retract the bolt. Thus operating personnel are assured that cylinder 16 is properly operated before cylinder 20 can be operated, as key 24 associated with cylinder 16 cannot be withdrawn without moving pin 96 back to its original position and engaged with surface 124.

Another key indicated at 136 in FIG. 13 is then used to operate cylinder 20 in a manner similar to that described for key 24 and cylinder 18 to in turn rotate pin 98 against an adjacent radial edge of recess 122 and move the bolt 22 fully into the housing. Key 136 now cannot be retracted from the cylinder without rotating the same from the end stop surfaces of the corresponding grooves 90 and this would return the bolt 22 to its fully extended position. The key 24 is also retained in position, as the recess 120 is now fully withdrawn from alignment with boss 14 and is located adjacent the flange 119 where the bolt may operate appropriate apparatus such as plunger 118. A clear indication of the condition of the associated apparatus is thus thus provided.

To retract the operating keys 24 and 136, the key 136 is rotated from the end surfaces of the respective grooves 90 to align pins 100 with slots 88 to permit withdrawal of key 136. The recess 120 of bolt 22 is now aligned with boss 14 and key 24 is operated to move pin 96 into recess 120 and align its pins 100 with the respective slots 88 for enabling withdrawal of the key and thus clearly indicate the condition of the locks. This ensures that bolt 22 is fully extended or in a predetermined condition before other apparatus located in another portion of the plant can be enabled, since the other apparatus may require key 24 or 136 to be used to enable the same. This ensures that each piece of apparatus is controlled in the proper sequence and permits changes in the sequence by using lock cylinders requiring the same key at different locations without necessitating a physical interconnection between the apparatus.

To remove either of the lock cylinders 18 or 20 for replacement or for changing of the tumbler pin arrangement, the extraction key 28 is utilized. Changing of the lock cylinder may be required, for example, when it is desired to utilize the cylinder 18 or 20 and its respective key to control another piece of apparatus or if it is desired to place bolt 22 under control of still another key.

The annular wall 86 on the extraction key 28 is moved into overlapping relationship with sleeve portion 80 of either cylinder 18 or 20. The pins 102 move in slots 88 until the front face 44 of barrel 34 engages stop wall 106, assuming each pin 102 is in a respective one of slots 88. The pins 102 are then aligned with grooves 92 and pins 30 have moved the tumbler pins 40, 48 and 50 to a position in which the interface between pins 40 and 50 is located at a position axially coincident with the engaged radial faces of barrels 34 and 36. The axial extent of the pins 30 is, of course, chosen to operate pins 40 of each cylinder 18 and 20 to the desired axial position. Since seven pins are chosen to provide the operating combination for each key, the key 28 can operate an extremely large number of locks with different tumbler pin combinations, although as a practical matter most situations require an extraction key operating only up to 50 different combination locks.

When key 28 is rotated, the pins 30 rotate barrel 34 to rotate the drive plate 66 in the direction opposite to that of the operating key. This rotation can only occur in a direction opposite the direction of initial rotation of the respective operating key to ensure that the associated apparatus cannot be properly conditioned. When the pins 102 engage the end or stop surfaces of the respective grooves 92, the slot 78 in the drive plate is automatically aligned with boss 74 and slot 76. Rotation of the drive plate of cylinder 20 also disengages the pin 98 from the bolt by movement into the space 116 above the bolt, while rotation of cylinder 16 moves the pin 96 into the enlarged space defined by bolt surface 126. With key 28 engaged in the groove 92 the lock cylinder 18 or 20 is now simply retracted from the respective boss passage 17 to permit replacement of the cylinder or change of the tumbler pins It will be noted that the cylinders can be extracted only when the bolt is in a selected position such as shown in FIG. 12, as pins 96 and 98 cannot be otherwise moved into the space below surface 132 and the space 116 respectively.

To reinsert a lock cylinder in a boss, the key 28 is associated with the lock cylinder to rotate the barrel 34 and drive plate 66 for aligning slot 78 with slot 76 and the lock cylinder inserted in the boss until the drive plate bottoms against the bolt at which time, slot 78 is past the key 74. The key 28 is now rotated to align pins 102 with grooves 88, which in turn rotates the drive plate 66 for engaging pin 96 or 98 with the appropriate bolt recess while moving slot 78 from alignment with the key 74. The key 28 may now be simply retracted from the lock cylinder, which is retained in the boss by the interference of key 72 with drive plate 66.

It will be noted that the described housing and bolt arrangement permit facile additions or changes, since the housings are easily stacked and bolts of appropriate length and configuration facily manufactured and inserted.

The foregoing is a description of an improved and more economical lock extraction apparatus or assembly whose inventive concepts are not limited to the described embodiment or environment, but are believed set forth in the accompanying claims.

What is claimed is:

1. A combination comprising a plurality of combination lock cylinders, a selected housing for each lock cylinder, a common bolt for said lock cylinders having a selected position, a respective tumbler barrel carried by each lock cylinder and adapted to receive a respective operating key, a plurality of axially movable tumbler pins carried by each lock cylinder to prevent rotation of a respective tumbler barrel and movement of said bolt from said selected position, said pins moved along the axis of a respective cylinder by a respective received operating key to enable initial rotation of a respective tumbler barrel in a respective initial direction for controlling said bolt to enable movement of said bolt from said selected position, each lock cylinder also adapted to receive a lock cylinder extraction key common to each cylinder for axially moving said pins to enable initial rotation by said extraction key of the respective barrel in a direction opposite each respective direction, means effective only in response to said bolt being in said selected position for enabling initial rotation of the respective barrel by said extraction key only in a direction opposite the respective direction and for enabling extraction of the respective lock cylinder from the selected housing.

2. The improvement claimed in claim 1 in which said means enabling initial rotation by said extraction key includes a first bayonet groove for each cylinder extending in a direction opposite the respective direction for engagement only by said lock cylinder extraction key.

3. For use with a plurality of combination lock cylinders each secured in a selected housing and adapted to receive a respective operating key for axially moving a plurality of axially movable tumbler pins carried by each lock cylinder to enable initial rotation of a tumbler barrel in a respective direction for controlling a bolt with each lock cylinder also adapted to receive a lock cylinder extraction key common to each cylinder for axially moving said pins to enable rotation of the respective barrel, the improvement comprising;

means on each lock cylinder enabling initial rotation of the respective barrel by said extraction key in a direction opposite the respective direction for enabling release of the respective lock cylinder from the selected housing, said means including a first bayonet groove for each cylinder extending in a direction opposite the respective direction for engagement only by said lock cylinder extraction key, each cylinder having a second bayonet groove extending in the respective direction, each said second bayonet groove offset axially relative said lock cylinder from the respective first groove for engagement only by a respective operating key.

4. In the improvement claimed in claim 3 a drive plate for each lock cylinder adapted to be rotated in one direction by a respective barrel for controlling said bolt, and means on said drive plate rotated to a selected position by said barrel in response to the rotation of said barrel in the opposite direction for enabling release of said cylinder from said housing.

5. In the improvement claimed in claim 4, an axially extending slot interconnecting said first and second grooves.

6. The improvement claimed in claim 5 in which each groove has a stop end for limiting rotation to a corresponding angle.

7. The improvement claimed in claim 6 in which each key is rotated in a direction from a respective stop end for rotating said drive plate in a corresponding direction and for enabling release of said key from the respective groove.

8. In the improvement claimed in claim 5 in which each key has a bayonet pin and a plurality of tumbler control pins.

9. The improvement claimed in claim 8 in which each lock cylinder includes an annular sleeve in which each bayonet groove is formed and each key includes a back wall for supporting said tumbler control pins with an annular wall adapted to receive said sleeve and supporting the respective bayonet pin.

10. The improvement claimed in claim 9 in which the annular wall on each key carries the respective bayonet pin and the bayonet pin on each operating key is located one selected axial distance from the respective back wall and the bayonet pin on said master key is located another axial distance from the respective back wall.

11. The improvement claimed in claim 10 in which said back wall positions each bayonet pin in alignment with a respective bayonet groove and one of said pins is adapted to move in said axially extending slot past one of said bayonet grooves.

12. The improvement claimed in claim 4 in which one housing carries a pair of lock cylinders and a bolt having a semi-cylindrical portion with a pair of spaced radially extending recesses formed in the flat face of said semi-cylindrical portion, and the drive plate for each cylinder has a respective operating pin projecting into a respective one of said recesses for controlling the movement of said bolt.

13. The improvement claimed in claim 12 in which the edges of one of said recesses are spaced for enabling rotation of the respective drive plate to engage a respective edge for moving said bolt in each direction and an edge of the other recess is spaced for engaging the operating pin of the other drive plate in response to rotation of the other drive plate is for preventing movement of said bolt in a respective direction.

14. An interlock system for use with a plurality of combination lock cylinders each carried in a respective housing portion and each having a tumbler barrel carrying a plurality of axially movable tumbler pins adapted to enable rotation of the respective tumbler barrel in a respective direction for controlling a bolt and rotation of said barrel in the opposite direction for releasing the respective lock cylinder from said housing, the improvement comprising:

an operating key for each cylinder with each operating key having tumbler control means for moving the tumbler pins of the respective cylinder to a selected position for enabling rotation of the respective barrel, first means for thereafter enabling initial rotation of said operating key to rotate the respective barrel only in a respective direction to control said bolt, an extraction key having tumbler control means for moving the tumbler pins of each of said lock cylinders to another selected position for enabling rotation of the respective barrel of each cylinder, and second means for thereafter enabling initial rotation of said extraction key to initially rotate the respective barrel only in a direction opposite said respective direction for enabling the release of the respective lock cylinder from the respective housing.

15. An interlock system for use with a plurality of combination lock cylinders each carried in a respective housing portion and each having a tumbler barrel carrying a plurality of axially movable tumbler pins adapted to enable rotation of the respective tumbler barrel in a respective direction for controlling a bolt and rotation of said barrel in the opposite direction for releasing the respective lock cylinder from said housing, the improvement comprising;

an operating key for each cylinder with each operating key having tumbler control means for moving the tumbler pins of the respective cylinder to a selected position for enabling rotation of the respective barrel, first means for thereafter enabling initial rotation of said operating key to rotate the respective barrel only in a respective direction to control said bolt, an extraction key having tumbler control means for moving the tumbler pins of each of said lock cylinders to another selected position for enabling rotation of the respective barrel of each cylinder, second means for thereafter enabling initial rotation of said extraction key to rotate the respective barrel only in a direction opposite said respective direction for enabling the release of the respective lock cylinder from the respective housing, said first means comprising a first pair of bayonet grooves extending in a selected angular direction and a first pair of bayonet pins on each operating key with each bayonet pin adapted to be engaged in a respective one of said pair of grooves to enable rotation of the operating key, and said second means comprises a second pair of bayonet grooves offset axially relative said first pair of bayonet grooves and extending in an opposite angular direction to said selected angular direction, and a pair of bayonet pins on said extraction key for engagement in a respective one of said second pair of bayonet grooves.

16. The interlock system claimed in claim 15 in which each lock cylinder includes an end face and an annular recess in which said bayonet grooves are located with one groove of each pair interconnected by a common groove extending axially to said end face for alternately receiving a respective bayonet pin on an operating key and on said extraction key.

17. The interlock system claimed in claim 16 in which each key has a cup shape with a back wall adapted to engage said end face and each said tumbler control means comprises a plurality of pins projecting from said back wall for moving said tumbler pins axially of said sleeve and the annular wall of said cup shape carries said pins for engaging a respective pair of grooves in response to said back wall engaging said end face.

18. The interlock claimed in claim 17 in which each lock cylinder has a drive plate rotated in response to the rotation of the respective tumbler barrel, means on each drive plate for controlling said bolt in one manner in response to initial rotation in a selected direction of the respective barrel and in another manner in response to subsequent lock cylinder and a bayonet key axially positioned on rotation in a reverse direction.

19. The interlock system claimed in claim 18 in which said drive plate includes means for releasing said lock cylinder from said housing in response to initial rotation of said barrel in said reverse direction.

20. The interlock system claimed in claim 19 in which one pair of bayonet grooves extend angularly a different distance than the other pair of bayonet slots and each groove has an end face for terminating rotation.

21. The system claimed in claim 14 in which each lock cylinder is released from the respective housing portion in response to said initial rotation by said extraction key to a respective predetermined position and axial movement in one direction by said extraction key to axially move the respective cylinder from said housing portion by said extraction key.

22. In the system claimed in claim 14, means for enabling rotation of one tumbler barrel and movement of said bolt by one operating key only in response to rotation of another tumbler barrel to a predetermined position by another operating key, and means for preventing disengagement of said other operating key from the respective lock cylinder in response to movement of said bolt in one direction.

23. In the system claimed in claim 22, means for preventing disengagement of said one operating key from the respective lock cylinder in response to the rotation of the respective barrel for moving said bolt in said one direction.

24. A method for changing combination locks of the axially movable pin type used in controlling switchgear comprising the steps of providing:

a housing carrying a plurality of locks each having a rotatable tumbler for controlling a bolt movable to alter the condition of said switchgear, an operating key for each lock adapted to initially rotate the respective tumbler in a respective direction, an extraction key common to each lock adapted to rotate each tumbler for enabling disengagement of each lock from said housing, and means for enabling said extraction key to initially rotate each tumbler only in a direction opposite said respective direction to prevent an alteration in the condition of said switchgear in response to rotation of said tumbler barrel by said extraction key.

* * * * *